US007240819B2

(12) United States Patent
Chang

(10) Patent No.: US 7,240,819 B2
(45) **Date of Patent: *Jul. 10, 2007**

(54) STAPLING DEVICE HAVING REAR HOUSING OPENING

(76) Inventor: Chun Yuan Chang, 5F-1, No. 81, Sec. 2, Chernder Road, Taipei 10353 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/329,520

(22) Filed: Jan. 11, 2006

(65) Prior Publication Data

US 2006/0108392 A1 May 25, 2006

Related U.S. Application Data

(63) Continuation-in-part of application No. 10/971,406, filed on Oct. 25, 2004, now Pat. No. 7,014,090.

(51) Int. Cl.
*B25C 1/00* (2006.01)
*B25C 5/06* (2006.01)

(52) U.S. Cl. ..... 227/132; 227/120; 227/124; 227/134

(58) Field of Classification Search ..... 227/120, 227/119, 96, 134, 128, 123, 124, 132, 110
See application file for complete search history.

(56) References Cited

U.S. PATENT DOCUMENTS 2,312,142 A * 2/1943 Berger et al. ..... 227/134
2,801,414 A * 8/1957 Mueller ..... 227/127
3,625,408 A * 12/1971 Amakawa et al. ..... 227/131
4,025,031 A * 5/1977 Chi ..... 227/132
4,113,164 A * 9/1978 Muthenthaller ..... 227/124
4,202,480 A * 5/1980 Annett ..... 227/8
4,225,075 A * 9/1980 Chi ..... 227/119
5,009,356 A * 4/1991 Chang ..... 227/120
5,632,431 A * 5/1997 Lin ..... 227/109
5,639,007 A * 6/1997 Nakamura ..... 227/109
5,899,374 A * 5/1999 Chen ..... 227/120
5,931,365 A * 8/1999 Huang ..... 227/109
6,142,355 A 11/2000 Wu ..... 227/134
6,367,676 B1 * 4/2002 Opland et al. ..... 227/123

* cited by examiner

*Primary Examiner*—Brian Nash
(74) *Attorney, Agent, or Firm*—Charles E. Baxley

(57) ABSTRACT

A stapling device includes a housing pivotally attached to a base member and having a channel for receiving staples, a staple drive plate slidably received in the housing and movable to drive the staples, a staple pushing device includes a casing slidably engaged in the channel of the housing and a pusher for forcing the staples forwardly toward the staple drive plate, and an actuating device for actuating the staple drive plate to drive the staples. The staple pushing device may be easily and readily assembled into the housing, and includes a projection or protrusion for detachably anchoring the staple pushing device to the housing.

8 Claims, 4 Drawing Sheets

STAPLING DEVICE HAVING REAR HOUSING OPENING

The present invention is a continuation-in-part of U.S. patent application Ser. No. 10/971,406, filed 25 Oct. 2004, now U.S. Pat. No. 7,014,090.

BACKGROUND OF THE INVENTION

1. Field of the Invention

The present invention relates to a stapling device, and more particularly to a stapling device having a staple pushing device openable rearwardly from a stapler housing, to allow staples to be easily and quickly changed with new staples, to allow the staple pushing device to be easily disassembled or disengaged form the stapler housing and to be easily assembled together.

2. Description of the Prior Art

Various kinds of typical stapling devices have been developed and comprise a base member having an anvil plate, a staple magazine member and a driving member provided with a staple drive plate. A staple guide member and a staple feeder are coupled to the driving member, to feed the staples toward the driving member, and to allow the staples to be suitably driven or hammered by the driving member.

For example, U.S. Pat. No. 6,142,355 to Wu discloses one of the typical stapling devices also comprising a staple guide member and a staple feeder to feed the staples toward a driving member. The driving member should be opened or rotated relative to the staple magazine member, to allow new staples to be engaged or fed into the staple magazine member.

In operation, the users may have to use their one hand to hold the base member, and use the other hand to open or rotate the driving member relative to the staple magazine member, and then to use one of the hands to move the staple guide member and/or the staple feeder, to allow the new staples to be engaged or fed into the staple magazine member. However, it will be difficult for the users to open the driving member, and then to change or to insert the new staples.

The present invention has arisen to mitigate and/or obviate the afore-described disadvantages of the conventional staplers or stapling devices.

SUMMARY OF THE INVENTION

The primary objective of the present invention is to provide a stapling device including a staple pushing device openable rearwardly from a stapler housing, to allow staples to be easily and quickly changed with new staples.

The other objective of the present invention is to provide a stapling device including a structure that allows the staple pushing device to be easily disassembled or disengaged form the stapler housing and to be easily assembled together.

In accordance with one aspect of the invention, there is provided a stapling device comprising a base member, a housing pivotally attached to the base member, and including a channel formed by a partition for receiving staples, the channel of the housing having a rear inlet, and the housing including a passage formed in a front portion and communicating with the channel of the housing, a staple drive plate slidably received in the passage of the housing, and movable into the channel of the housing for staple driving purpose, a staple pushing device including a casing slidably engaged in the channel of the housing via the rear inlet of the housing, and including a spring-biased pusher for forcing and feeding the staples forwardly toward the staple drive plate and for allowing the staples to be driven by the staple drive plate, and an actuating device for actuating the staple drive plate to drive the staples. The staple pushing device may be easily and readily engaged or assembled into the channel of the housing via the rear inlet of the housing.

The staple pushing device includes a spring biasing member engaged with the pusher to bias the pusher and to feed the staples forwardly toward the staple drive plate. The staple pushing device includes a block attached to the casing, and the spring is engaged between the block and the pusher for biasing the pusher to engage with and to urge the staples.

The housing includes a depression, the staple pushing device includes a projection for engaging into the depression of the housing and for detachably anchoring the staple pushing device to the housing.

The housing may further include an anchoring member to define the rear inlet of the housing, the staple pushing device includes an anchoring protrusion for engaging with the anchoring member of the housing and for further detachably anchoring the staple pushing device to the housing.

The staple drive plate includes a cavity formed therein, the actuating device includes a lever pivotally secured in the housing with a pivot pin, and having a first end engageable into and disengageable from the cavity of the staple drive plate, and having a second end, and a drive member pivotally secured to the housing with a pivot shaft, and engaged with the second end of the lever, to selectively rotate the lever relative to the housing, and to selectively disengage from the cavity of the staple drive plate when the lever is depressed and actuated by the drive member.

A spring member may further be provided and engaged with the staple drive plate, to bias and force the staple drive plate to engage into the staple magazine and to drive the staples when the first end of the lever is disengaged from the cavity of the staple drive plate. The lever includes a spring biasing device for biasing the first end of the lever to engage into the cavity of the staple drive plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
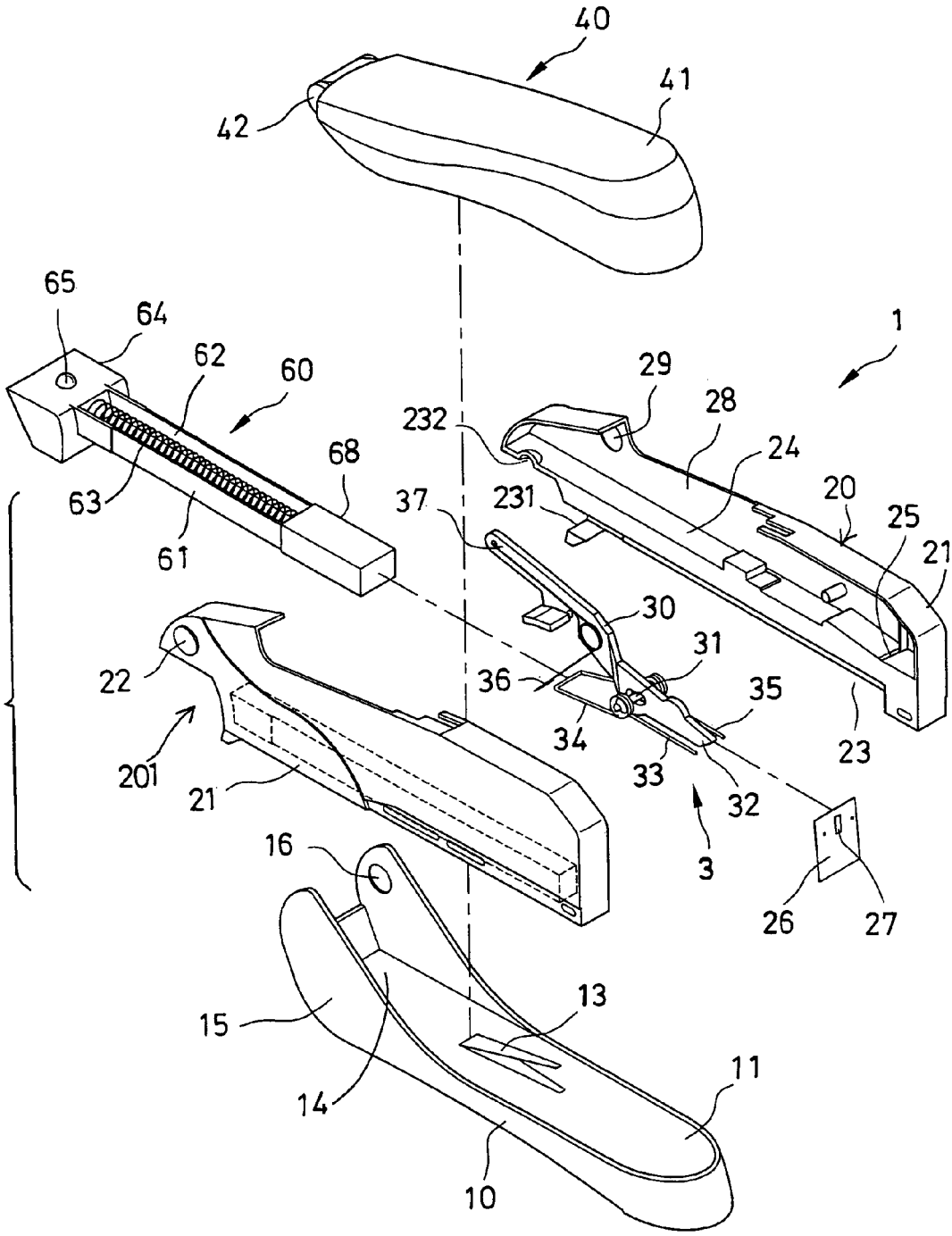
FIG. 1 is an exploded view of a stapling device in accordance with the present invention.
Figure 2:
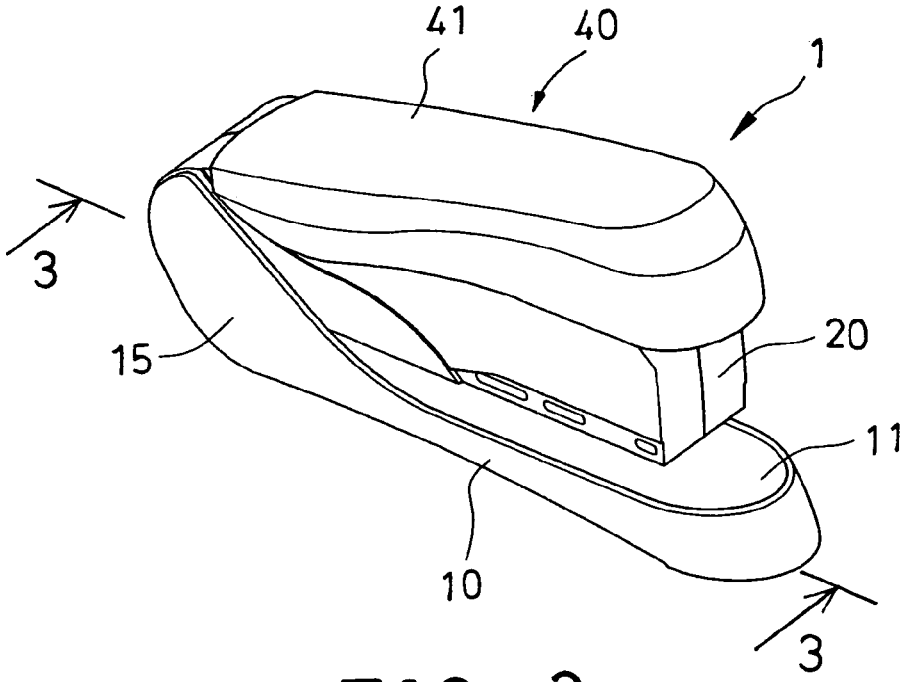
FIG. 2 is a perspective view of the stapling device.
Figure 3:
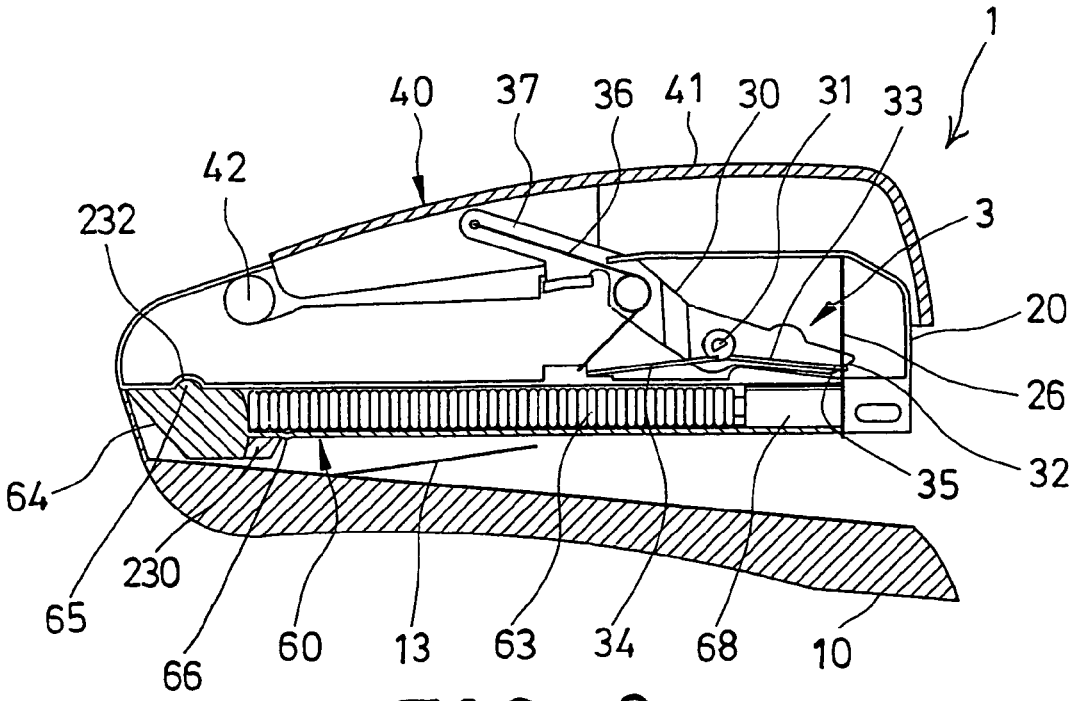
FIG. 3 is a partial cross sectional view taken along lines 3-3 of FIG. 2.
Figure 4:
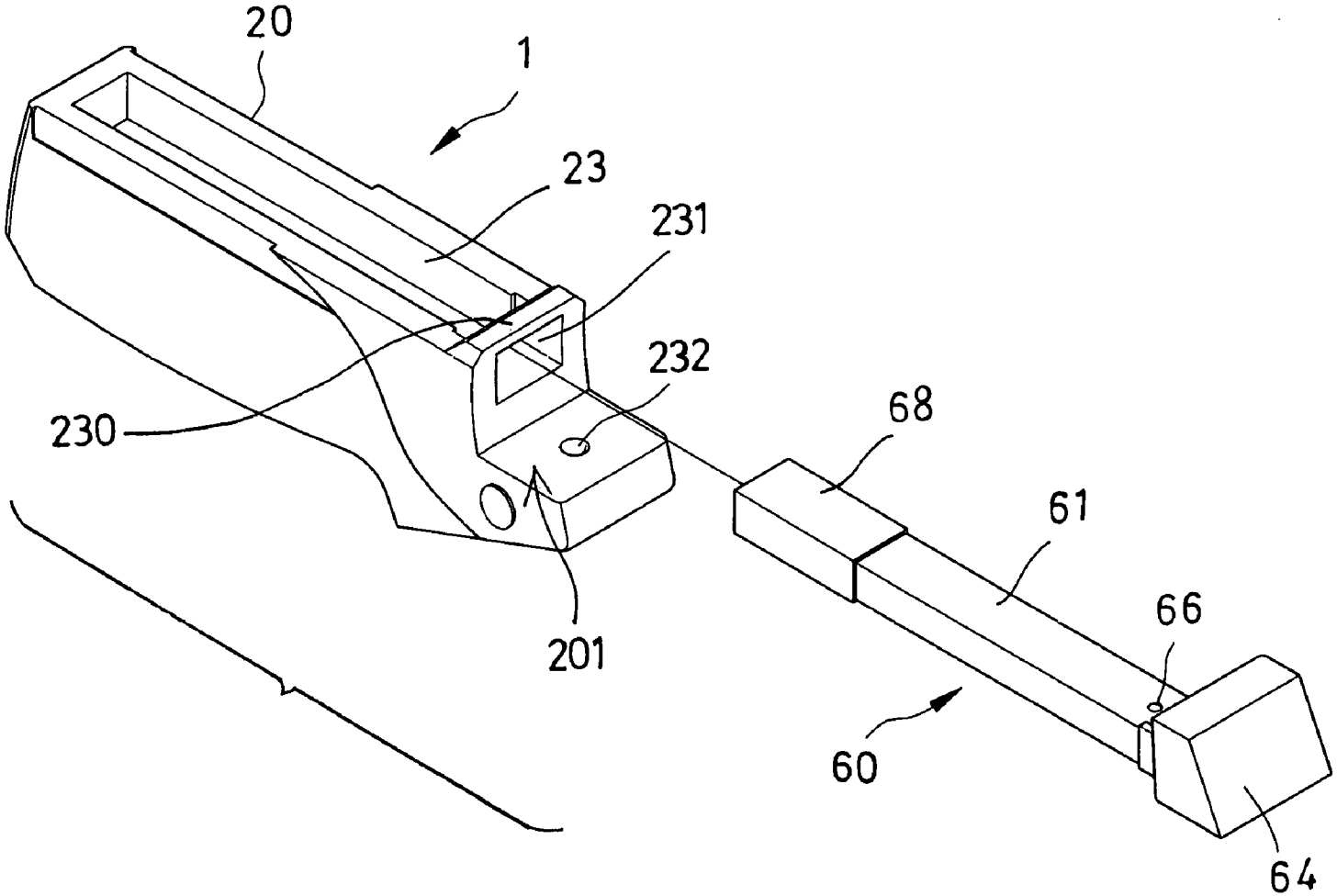
FIG. 4 is a partial exploded view of the stapling device as seen from the bottom portion of the stapling device.
Figure 5:
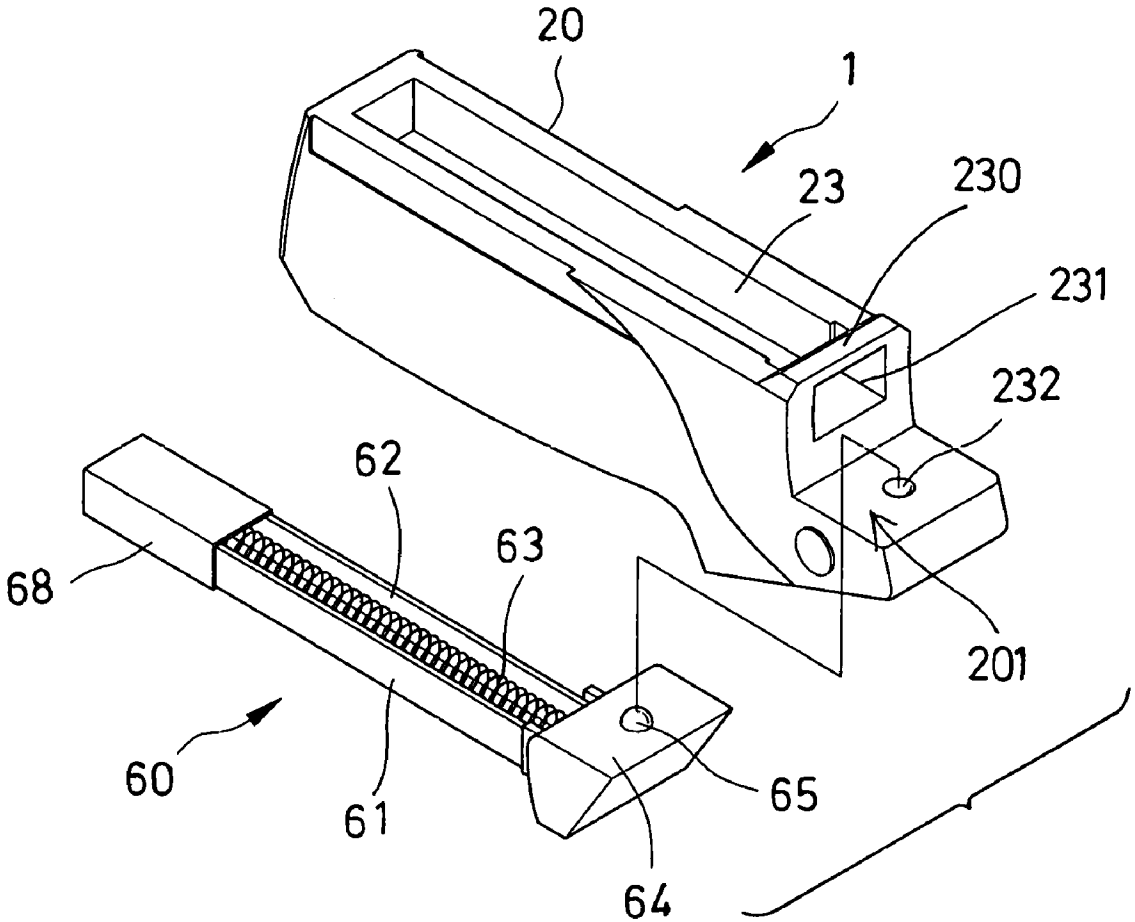
FIG. 5 is a partial exploded view similar to FIG. 4, in which a staple feeder or staple pushing device is disposed up side down relative to a housing for receiving staples.

Referring to the drawings, and initially to FIGS. 1-3, a stapling device 1 in accordance with the present invention comprises a base member 10, an anvil plate 11 disposed in the upper portion of the base member 10 and having one or more inward staple guide depressions (not shown) formed in such as a front portion thereof, and having a spring arm 13 extended upward from the rear portion thereof. The base member 10 includes a space 14 formed in the rear portion thereof, and defined between two side panels 15 each having a cavity 16 formed therein.

A housing 20 may include such as two housing members 21 secured together by fasteners, latches (not shown), adhesive materials, or by welding processes, or the like, and includes an axle 22 provided on one end thereof (FIG. 1) for engaging into the cavities 16 of the base member 10, and for rotatably securing the housing 20 to the base member 10, and for allowing the housing 20 to be rotated relative to the base member 10. For example, the axle 22 may be formed by one or more projections 22 that are extended from the housing 20.

The housing 20 includes a longitudinal recess or channel 23 formed or provided in the lower portion thereof, and defined by a partition 24 and having a rear inlet 231, and includes a passage 25 formed in the front portion thereof, and formed through the partition 24, and communicating with the longitudinal channel 23 of the housing 20, for slidably receiving a staple drive plate 26 therein which is aligned with the depression (not shown) of the base member 10 and which includes a cavity 27 formed therein. The longitudinal channel 23 of the housing 20 is provided for slidably receiving typical staples.

An actuating means or device 3 includes a lever 30 rotatably or pivotally secured in the housing 20 with a pivot pin 31, and having one or front end 32 engageable into and also disengageable from the cavity 27 of the staple drive plate 26. For example, the lever 30 is arranged to allow the front end 32 of the lever 30 to be engaged into the cavity 27 of the staple drive plate 26 when the front end 32 of the lever 30 is moved or rotated downwardly relative to the housing 20 (FIG. 3), and to be disengaged from the cavity 27 of the staple drive plate 26 when the front end 32 of the lever 30 is rotated upwardly relative to the housing 20 (not shown).

A spring member 33 may also be attached or engaged onto the pivot pin 31, and may have one end 34 rested on or secured to the base member 10, and the other end 35 attached or secured to the staple drive plate 26, in order to bias or spring the staple drive plate 26 downwardly and/or outwardly through the passage 25 of the housing 20, for staple driving purposes. Another spring member 36 may further be provided and attached or engaged between the lever 30 and the housing 20, to bias the front end 32 of the lever 30 to engage into the cavity 27 of the staple drive plate 26.

The housing 20 includes an opening 28 and one or more recesses 29 formed in the upper portion thereof. A drive member 40 includes one end 41 engaged onto the outer portion of the housing 20 and rotatably or pivotally attached or secured to the housing 20 with a pivot shaft 42 which is engaged in the recesses 29 of the housing 20, to allow the drive member 40 to be rotated relative to the housing 20. The other or rear end 37 of the lever 30 is engaged with the drive member 40 (FIG. 3) to allow the drive member 40 to rotate the lever 30, and to force and to disengage the front end 32 of the lever 30 from the cavity 27 of the staple drive plate 26. The above structure has been disclosed in the co-pending U.S. patent application Ser. No. 10/971,406, filed 25 Oct. 2004, which may be taken as a reference for the present invention.

As shown in FIGS. 1 and 3-5, the housing 20 includes a notch 201 formed in the rear portion thereof and communicating with the longitudinal channel 23 of the housing 20, and further includes an anchoring bar or member 230 provided or formed in the rear portion thereof for forming or defining the rear inlet 231 of the housing 20, and includes a depression 232 formed in the rear portion thereof and communicating with the notch 201 of the housing 20. A staple feeder or staple pushing device 60 includes a casing 61 slidably received or engaged in the longitudinal channel 23 of the housing 20 via the rear inlet 231 of the housing 20, and includes a longitudinal slot 62 formed in such as the upper portion thereof for receiving a spring biasing means or member 63.

The staple pushing device 60 includes a block 64 formed integral on or attached or secured to one end of the casing 61 for slidably engaging the casing 61 into and out of the longitudinal channel 23 of the housing 20. The block 64 of the staple pushing device 60 includes a projection 65 extended therefrom for engaging into the depression 232 of the housing 20 and for detachably anchoring or retaining or securing the casing 61 of the staple pushing device 60 to the housing 20. The staple pushing device 60 may further include an anchoring peg or protrusion 66 extended from the casing 61 (FIG. 4) for engaging with the anchoring member 230 (FIG. 3) and for further detachably anchoring or retaining or securing the casing 61 of the staple pushing device 60 to the housing 20.

A pusher 68 is slidably engaged onto the casing 61, and the spring member 63 is engaged or coupled between the block 61 or the casing 61 and the pusher 68 for biasing the pusher 68 away from the block 61, and for biasing or actuating the pusher 68 to force and to feed the staples forwardly toward the staple drive plate 26 (FIG. 3), and thus for allowing the staples to be driven or hammered by the staple drive plate 26.

In operation, as shown in FIG. 3, when the drive member 40 is depressed or rotated downwardly relative to the housing 20, the other or rear end 37 of the lever 30 may be actuated or depressed by the drive member 40, to force and to disengage the front end 32 of the lever 30 from the cavity 27 of the staple drive plate 26, and thus to allow the staple drive plate 26 to be biased or forced downwardly and/or outwardly through the passage 25 of the housing 20 to drive or hammer the staples by the spring member 33.

When the drive member 40 is released, the other spring member 36 may bias and rotate the lever 30 relative to the housing 20, to bias the front end 32 of the lever 30 to engage into the cavity 27 of the staple drive plate 26 again, and to the original or normal position ready for further staple driving operation. The spring arm 13 of the base member 10 may be used to bias the housing 20 upwardly away from the base member 10 to the original or normal position.

The staples to be easily engaged into or disengaged from the longitudinal channel 23 of the housing 20, and the staple pushing device 60 may be easily and quickly assembled or engaged into and removed or disengaged from the housing 20 with the block 61.

Accordingly, the stapling device in accordance with the present invention includes a staple pushing device openable rearwardly from a stapler housing, to allow staples to be easily and quickly changed with new staples, and includes a structure that allows the staple pushing device to be easily disassembled or disengaged form the stapler housing and to be easily assembled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapling device comprising:

a base member, a housing pivotally attached to said base member, and including a channel formed by a partition for receiving staples, said channel of said housing having a rear inlet, and said housing including a passage formed in a front portion and communicating with said channel of said housing, a staple drive plate slidably received in said passage of said housing, and movable into said channel of said housing for staple driving purpose, a staple pushing device including a casing slidably engaged in said channel of said housing via said rear inlet of said housing, and including a spring-biased pusher for forcing and feeding the staples forwardly toward said staple drive plate and for allowing the staples to be driven by said staple drive plate, and means for actuating said staple drive plate to drive the staples.

2. The stapling device as claimed in claim 1, wherein said staple pushing device includes a spring engaged with said pusher to bias said pusher and to feed the staples forwardly toward said staple drive plate.

3. The stapling device as claimed in claim 2, wherein said staple pushing device includes a block attached to said casing, said spring is engaged between said block and said pusher.

4. The stapling device as claimed in claim 1, wherein said housing includes a depression, said staple pushing device includes a projection for engaging into said depression of said housing and for detachably anchoring said staple pushing device to said housing.

5. The stapling device as claimed in claim 1, wherein said housing includes an anchoring member to define said rear inlet of said housing, said staple pushing device includes an anchoring protrusion for engaging with said anchoring member of said housing and for detachably anchoring said staple pushing device to said housing.

6. The stapling device as claimed in claim 1, wherein said staple drive plate includes a cavity formed therein, said actuating means includes a lever pivotally secured in said housing with a pivot pin, and having a first end engageable into and disengageable from said cavity of said staple drive plate, and having a second end, and a drive member pivotally secured to said housing with a pivot shaft, and engaged with said second end of said lever, to selectively rotate said lever relative to said housing, and to selectively disengage from said cavity of said staple drive plate when said lever is depressed and actuated by said drive member.

7. The stapling device as claimed in claim 6, wherein a spring member is engaged with said staple drive plate, to bias and force said staple drive plate to engage into said staple magazine and to drive the staples when said first end of said lever is disengaged from said cavity of said staple drive plate.

8. The stapling device as claimed in claim 6, wherein said lever includes means for biasing said first end of said lever to engage into said cavity of said staple drive plate.

* * * * *